US007357126B2

(12) United States Patent
Durand et al.

(10) Patent No.: US 7,357,126 B2
(45) Date of Patent: Apr. 15, 2008

(54) CORROSIVE RESISTANT HEAT EXCHANGER

(75) Inventors: James Carl Durand, Dunlap, IL (US); Ajey Janardan Kulkami, Saint Ismier (FR)

(73) Assignee: Caterpillar Inc., Peoria, IL (US)

( * ) Notice: Subject to any disclaimer, the term of this patent is extended or adjusted under 35 U.S.C. 154(b) by 31 days.

(21) Appl. No.: 11/311,303

(22) Filed: Dec. 20, 2005

(65) Prior Publication Data

US 2007/0137627 A1 Jun. 21, 2007

(51) Int. Cl.
*F02M 25/07* (2006.01)
*F02B 47/08* (2006.01)

(52) U.S. Cl. ..... 123/568.11; 123/568.12

(58) Field of Classification Search ..... 123/198 R, 123/198 A, 568.11, 568.12, 668, 669; 165/95, 165/133, 134.1

See application file for complete search history.

(56) References Cited

U.S. PATENT DOCUMENTS

| | | | | |
|---|---|---|---|---|
| 3,880,232 | A | 4/1975 | Parker | |
| 4,106,449 | A * | 8/1978 | Matsumoto et al. | 123/568.12 |
| 4,210,127 | A | 7/1980 | Kleine et al. | |
| 4,263,966 | A | 4/1981 | Östbo | |
| 4,600,053 | A | 7/1986 | Patel et al. | |
| 4,676,304 | A | 6/1987 | Koisuka et al. | |
| 5,174,370 | A | 12/1992 | Hallgren | |
| 5,271,376 | A | 12/1993 | Lu et al. | |
| 5,323,849 | A | 6/1994 | Korczynski, Jr. et al. | |
| 5,525,311 | A | 6/1996 | Girod et al. | |
| 5,540,899 | A | 7/1996 | Koves | |
| 5,573,062 | A | 11/1996 | Ooba et al. | |
| 5,762,887 | A | 6/1998 | Girod et al. | |
| 5,839,505 | A | 11/1998 | Ludwig et al. | |
| 6,119,769 | A | 9/2000 | Yu et al. | |
| 6,286,588 | B1 | 9/2001 | Uehara | |
| 6,568,465 | B1 | 5/2003 | Meissner et al. | |
| 2002/0035847 | A1 | 3/2002 | Yundt, Jr. | |
| 2002/0162646 | A1 | 11/2002 | Haasch et al. | |
| 2002/0179034 | A1 * | 12/2002 | Sisken | 123/198 A |

FOREIGN PATENT DOCUMENTS

| | | | | |
|---|---|---|---|---|
| BE | 1 009 593 A6 | | 5/1997 | |
| EP | 0 567 674 | | 11/1993 | |
| GB | 1399545 | | 7/1975 | |
| GB | 1399545 A | * | 7/1975 | |
| GB | 2 027 865 | | 2/1980 | |
| GB | 2 296 560 | | 3/1996 | |
| JP | 2000121286 A | * | 4/2000 | |
| JP | 2001330394 A | * | 11/2001 | 123/568.12 |
| JP | 2003184659 A | * | 7/2003 | 123/568.12 |
| JP | 2005090833 A | * | 4/2005 | 123/568.12 |

OTHER PUBLICATIONS

PCT International Search Report, PCT/US2006/040787; International Filing Date: Oct. 20, 2006; Applicant: Caterpillar Inc.

* cited by examiner

*Primary Examiner*—Willis R. Wolfe, Jr.
(74) *Attorney, Agent, or Firm*—Finnegan, Henderson, Farabow, Garrett & Dunne

(57) ABSTRACT

A heat exchanger for an air handling system is disclosed. The heat exchanger has an inlet, an outlet, and at least one passageway fluidly connecting the inlet and the outlet. The at least one passageway has a corrosive resistive feature that varies along a length of the at least one passageway.

19 Claims, 2 Drawing Sheets

CORROSIVE RESISTANT HEAT EXCHANGER

TECHNICAL FIELD

The present disclosure relates generally to a heat exchanger and, more particularly, to a heat exchanger having corrosive resisting characteristics.

BACKGROUND

Heat exchangers such as, for example, corrugated plate-type exchangers, shell and tube-type exchangers, tube and fin-type exchangers, and other types of heat exchangers known in the art are used to transfer thermal energy between two fluids without direct contact between the two fluids. In particular, a primary fluid is typically directed through a fluid passageway of the heat exchanger, while a cooling or heating fluid may be brought into external contact with the passageway. In this manner, heat may be conducted through walls of the passageway to thereby transfer energy between the two fluids. In some applications, one or both of the fluids circulated through the heat exchanger could have a corrosive nature and, over time, erode the walls of the fluid passageway. Without intervention, the walls of the fluid passageway could eventually fail, causing contamination of and/or functional loss of the heat exchanger.

One method implemented by heat exchanger manufacturers to accommodate the corrosive nature of the fluid(s) circulated through heat exchangers is described in U.S. Pat. No. 4,263,966 (the '966 patent), issued to Östbo on Apr. 28, 1981. In particular, the '966 patent describes a heat exchanger having cores made of a material with a high heat conducting capacity. The cores are provided with a covering made of another material that does not chemically or physically interact with the medium flowing in contact therewith. The covering completely shields off the cores from direct contact with the medium, thereby minimizing the likelihood of corrosion.

Although the heat exchanger covering of the '966 patent may help to reduce the likelihood of the medium eroding the core material, it may be excessive for some applications and expensive. Specifically, in some applications, the medium may be corrosive during movement through only a portion of the core. In these situations, a complete shielding of the entire core may be unwarranted and inefficient. In addition, because extra manufacturing procedures are required to apply the covering to the entire core, the cost of implementing the covering may be substantial.

The disclosed heat exchanger is directed to overcoming one or more of the problems set forth above.

SUMMARY OF THE INVENTION

In one aspect, the present disclosure is directed to a heat exchanger. The heat exchanger includes an inlet, an outlet, and at least one passageway fluidly connecting the inlet and the outlet. The at least one fluid passageway includes a corrosive resistive feature that varies along a length of the at least one passageway.

In yet another aspect, the present disclosure is directed to an air induction system for an engine. The air induction system includes a supply of air, a supply of recirculated exhaust gas, and a compressor in communication with the supply of air and the supply of recirculated exhaust gas. The compressor is configured to compress a mixture of air and recirculated exhaust gas. The air induction system also includes an inlet manifold in fluid communication with the engine and a heat exchanger. The heat exchanger is configured to cool the compressed air and recirculated exhaust gas mixture and to direct the cooled mixture to the inlet manifold. The heat exchanger includes an inlet in communication with the supply of air and the supply of recirculated exhaust gas, an outlet in communication with the inlet manifold, and at least one passageway fluidly connecting the inlet and the outlet. The at least one passageway includes a corrosive resistive feature that varies along a length of the at least one passageway.

DETAILED DESCRIPTION

Figure 1:
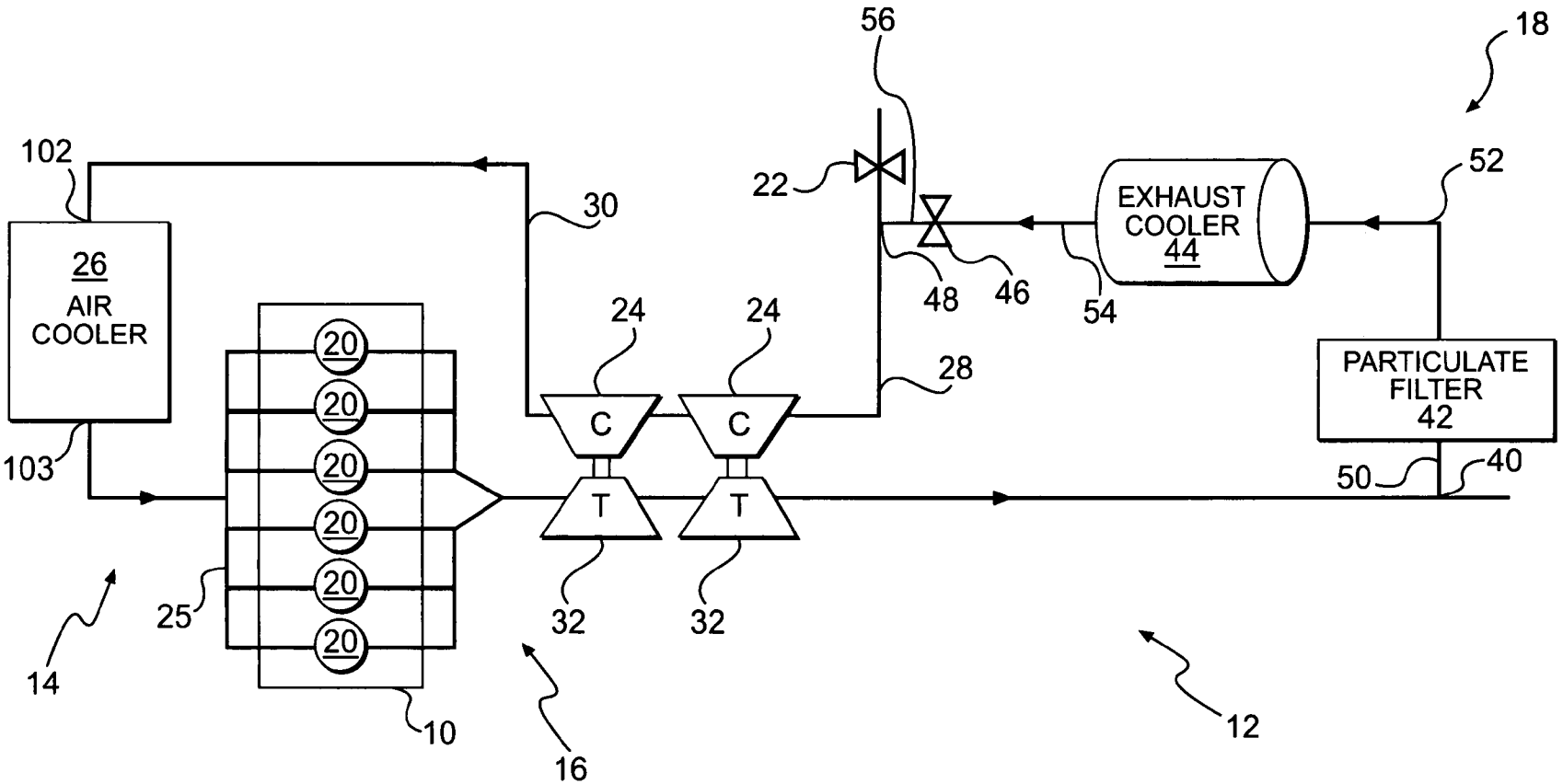
FIG. 1 is a diagrammatic illustration of a power source having an exemplary disclosed fluid handling system.

FIG. 1 illustrates a power source 10 having an exemplary fluid handling system 12. Power source 10 may include an engine such as, for example, a diesel engine, a gasoline engine, a gaseous fuel-powered engine such as a natural gas engine, or any other type of combustion engine apparent to one skilled in the art. Power source 10 may, alternatively, include another source of power such, for example, a furnace. Fluid handling system 12 may include, an exhaust system 16, a recirculation system 18, and an air induction system 14.

Exhaust system 16 may include a means for directing exhaust flow out of power source 10. For example, exhaust system 16 may include one or more turbines 32 connected in a series relationship. It is contemplated that exhaust system 16 may include additional components such as, for example, particulate traps, NOx absorbers, or other catalytic devices, attenuation devices, and other means for directing exhaust flow out of power source 10 that are known in the art.

Each turbine 32 may be connected to one or more compressors 24 of air induction system 14 and configured to drive the connected compressor 24. In particular, as the hot exhaust gases exiting power source 10 expand against blades (not shown) of turbine 32, turbine 32 may rotate and drive the connected compressor 24. It is contemplated that turbines 32 may alternatively be disposed in a parallel relationship or that only a single turbine 32 may be included within exhaust system 16. It is also contemplated that turbines 32 may be omitted and compressors 24 driven by power source 10 mechanically, hydraulically, electrically, or in any other manner known in the art, if desired.

Recirculation system 18 may include a means for redirecting a portion of the exhaust flow of power source 10 from exhaust system 16 into air induction system 14. For example, recirculation system 18 may include an inlet port 40, a recirculation particulate filter 42, an exhaust cooler 44, a recirculation valve 46, and a discharge port 48. It is contemplated that recirculation system 18 may include additional or different components such as a catalyst, an electrostatic precipitation device, a shield gas system, one or more sensing elements, and other means for redirecting that are known in the art Inlet port 40 may be connected to exhaust system 16 and configured to receive at least a portion of the exhaust flow from power source 10. Specifically, inlet port 40 may be disposed downstream of turbines 32 to receive low pressure exhaust gases from turbines 32. It is contemplated that inlet port 40 may alternatively be located upstream of turbines 32 for a high pressure recirculation application.

Recirculation particulate filter 42 may be connected to inlet port 40 via a fluid passageway 50 and configured to remove particulates from the portion of the exhaust flow directed through inlet port 40. Recirculation particulate filter 42 may include electrically conductive or non-conductive coarse mesh elements. It is contemplated that recirculation particulate filter 42 may include a catalyst for reducing an ignition temperature of the particulate matter trapped by recirculation particulate filter 42, a means for regenerating the particulate matter trapped by recirculation particulate filter 42, or both a catalyst and a means for regenerating. The means for regenerating may include, among other things, a fuel-powered burner, an electrically-resistive heater, an engine control strategy, or any other means for regenerating known in the art. It is contemplated that recirculation particulate filter 42 may be omitted, if desired.

Exhaust cooler 44 may be fluidly connected to recirculation particulate filter 42 via fluid passageway 52 and configured to cool the portion of exhaust gases flowing through inlet port 40. Exhaust cooler 44 may include a liquid-to-air heat exchanger, an air-to-air heat exchanger, or any other type of heat exchanger known in the art for cooling an exhaust flow. It is contemplated that exhaust cooler 44 may be omitted, if desired.

Recirculation valve 46 may be fluidly connected to exhaust cooler 44 via a fluid passageway 54 and configured to regulate the flow of exhaust through recirculation system 18. Recirculation valve 46 may embody a spool valve, a shutter valve, a butterfly valve, a check valve, a diaphragm valve, a gate valve, a shuttle valve, a ball valve, a globe valve, or any other valve known in the art. Recirculation valve 46 may be solenoid-actuated, hydraulically-actuated, pneumatically-actuated, or actuated in any other manner.

Air induction system 14 may include a means for introducing charged air into a combustion chamber 20 of power source 10. For example, air induction system 14 may include a induction valve 22, one or more compressors 24, and an air cooler 26. It is contemplated that additional components may be included within air induction system 14 such as, for example, additional valving, one or more air cleaners, one or more waste gates, a control system, and other means for introducing charged air into combustion chambers 20 that are known in the art.

Induction valve 22 may be fluidly connected to compressors 24 via a fluid passageway 28 and configured to regulate the flow of atmospheric air to power source 10. Induction valve 22 may embody a spool valve, a shutter valve, a butterfly valve, a check valve, a diaphragm valve, a gate valve, a shuttle valve, a ball valve, a globe valve, or any other type of valve known in the art. Induction valve 22 may be solenoid-actuated, hydraulically-actuated, pneumatically-actuated, or actuated in any other manner. Induction valve 22 may be in communication with a controller (not shown) and selectively actuated in response to one or more predetermined conditions.

Compressors 24 may be configured to compress the air flowing into power source 10 to a predetermined pressure level. Compressors 24 may be disposed in a series relationship and fluidly connected to power source 10 via a fluid passageway 30. Each of compressors 24 may include a fixed geometry compressor, a variable geometry compressor, or any other type of compressor known in the art. It is contemplated that compressors 24 may alternatively be disposed in a parallel relationship or that air induction system 14 may include only a single compressor 24. It is further contemplated that compressors 24 may be omitted, when a non-pressurized air induction system is desired.

Air cooler 26 may embody an air-to-air heat exchanger or an air-to-liquid heat exchanger and be configured to facilitate the transfer of thermal energy to or from the air and exhaust gas mixture directed into power source 10. For example, air cooler 26 may include a shell and tube-type heat exchanger, a corrugated plate-type heat exchanger, a tube and fin-type heat exchanger, or any other type of heat exchanger known in the art. Air cooler 26 may be connected to power source 10 via fluid passageway 30.

Figure 2:
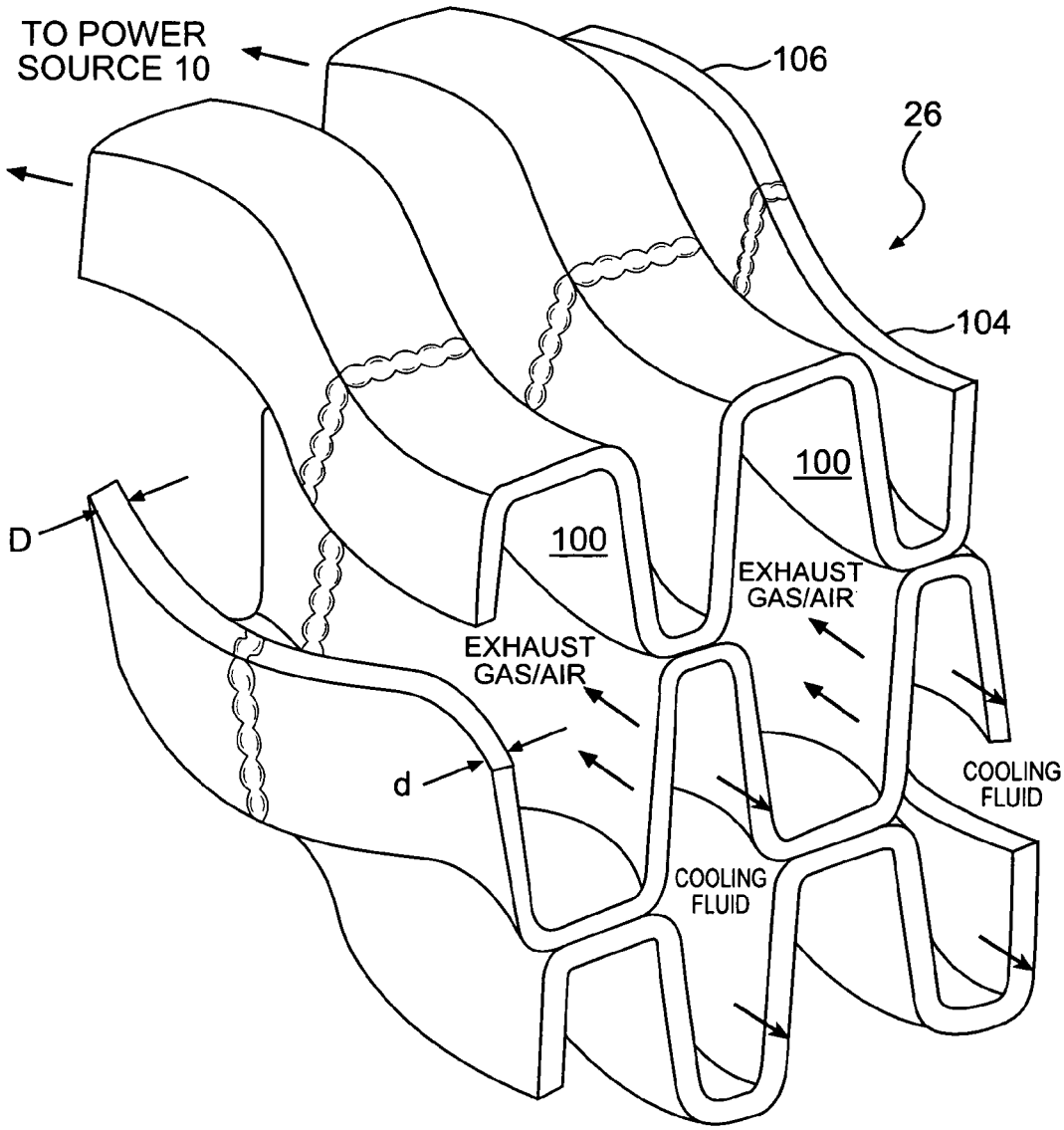
FIG. 2 is a pictorial illustration of an exemplary disclosed heat exchanger for the fluid handling system of FIG. 1.

As illustrated in FIG. 2, air cooler 26 may include one or more fluid passageways 100 configured to conduct the compressed mixture of recirculated exhaust gas and air from compressors 24 to power source 10 via an intake manifold 25 (referring to FIG. 1). Passageways 100 may be hollow members such as, for example tubes or assemblies of plates having mating corrugations extending from an inlet 102 (referring to FIG. 1) of air cooler 26 to an outlet 103 (referring to FIG. 1) of air cooler 26. As the recirculated exhaust gas and air mixture flows through passageways 100, a cooling medium such as air, water, glycol, a blended air mixture, a water/glycol mixture, a high pressure refrigerant, or any other suitable medium may contact and flow past external surfaces of passageways 100. The walls of passageways 100 may be thermally conductive such that energy may be transferred from the higher temperature recirculated exhaust gas and air mixture through the walls of passageways 100 to the lower temperature cooling medium.

Passageways 100 may have anti-corrosive characteristics that vary along the length of passageways 100. In particular, the wall material of passageways 100, the thickness of the passageway walls, and/or an anti-corrosive coating on the walls of passageways 100 may change along the length of passageways 100. For example, a first portion 104 of passageways 100 (e.g., the portion of passageways 100 nearest the inlet of air cooler 26) may be fabricated from aluminum, while a second portion 106 of passageways 100 (e.g., the portion of passageways 100 nearest the outlet of air cooler 26) may be fabricated from stainless steel. The first and second portions 104, 106 may be joined together through any manner known in the art such as, for example, through welding or chemical bonding. In another example, a thickness "D" of second portion 106 may be greater than a thickness "d" of first portion 104. In this example, the wall thickness of passageways 100 may vary gradually or, alternatively, in a stepwise manner at a predetermined location along the length of passageways 100. In yet another example, the anti-corrosive coating such as a metal or resin deposit may be thinly applied to the interior and/or exterior walls of first portion 104, while the same or a different anti-corrosive coating could be thickly applied to the interior and/or exterior walls of second portion 106. The thickness of the anti-corrosive coating may vary gradually or, alternatively, in a stepwise manner at the predetermined location. It is contemplated that within a single air cooler 26, any combination of the above characteristics may be implemented.

INDUSTRIAL APPLICABILITY

The disclosed fluid handling system may be implemented in any cooling or heating application where one or more of the fluids that flow through the system are corrosive. In particular, the disclosed fluid handling system may provide for extended heat exchanger component life in a simple and inexpensive package by varying corrosive resistant characteristics of the heat exchanger along a length of one or more heat exchanger passageways. The operation of fluid handling system 12 will now be explained.

Atmospheric air may be drawn into air induction system 14 via induction valve 22 to compressors 24 where it may be pressurized to a predetermined level before entering combustion chambers 20 of power source 10. Fuel may be mixed with the pressurized air before or after entering combustion chambers 20. This fuel-air mixture may then be combusted by power source 10 to produce mechanical work and an exhaust flow containing gaseous compounds and solid particulate matter. The exhaust flow may be directed from power source 10 to turbines 32 where the expansion of hot exhaust gasses may cause turbines 32 to rotate, thereby rotating connected compressors 24 and compressing the inlet air. After exiting turbines 32, the exhaust gas flow may be divided into two flows, including a first flow redirected to air induction system 14 and a second flow directed to the atmosphere.

As the first exhaust flow moves through inlet port 40 of recirculation system 18, it may be filtered by recirculation particulate filter 42 to remove particulate matter prior to communication with exhaust cooler 44. The particulate matter, when deposited on the mesh elements of recirculation particulate filter 42, may be passively and/or actively regenerated.

The flow of the reduced-particulate exhaust from recirculation particulate filter 42 may be cooled by exhaust cooler 44 to a predetermined temperature and then directed through recirculation valve 46 to be drawn back into air induction system 14 by compressors 24. The recirculated exhaust flow may then be mixed with the air entering combustion chambers 20. The exhaust gas, which is directed to combustion chambers 20, may reduce the concentration of oxygen therein, which in turn lowers the maximum combustion temperature within power source 10. The lowered maximum combustion temperature may slow the chemical reaction of the combustion process, thereby decreasing the formation of nitrous oxides. In this manner, the gaseous pollution produced by power source 10 may be reduced.

As the mixture of inlet air and recirculated exhaust gases flow through air cooler 26, moisture from the cooling mixture may condense on the interior surfaces of passageways 100. That is, as the mixture travels along the length of passageways 100 from the inlet to the outlet of air cooler 26, the mixture may cool to a lower and lower temperature and, because cooler air can retain less moisture than warmer air, moisture from the cooling mixture may condense at a greater rate within second portion 106 than in first portion 104. This condensation within second portion 106 may be corrosive to the core material of the passageway walls and, if left unchecked, could eventually erode away passageways 100 resulting in system rupture and/or contamination.

As described above, to minimize the erosive effects of the condensing moisture, characteristics of the heat exchanger passageway walls may be varied along the length of passageways 100. In particular, the material of the passageway walls may change from, for example, aluminum in first portion 104 to a higher resistive material such as stainless steel in second portion 106; the thickness of the passageway walls may be increased from the inlet to the outlet of air cooler 26; and/or an anti-corrosive coating may be applied to the passageway walls at an increasing thickness along the length of passageways 100. It is contemplated that the location of the material change from aluminum to stainless steel and the rates of changing wall and coating thicknesses may be related to conditions associated with particular applications of air cooler 26 such as, for example, the types, amounts, and flow rates of fluids directed through air cooler 26.

Because the anti-corrosive characteristics of air cooler 26 may vary along a flow length of air cooler 26 and according to application, the cost of air cooler 26 may be minimized. In particular, because the anti-corrosive characteristics are conservatively implemented (e.g., implemented only as necessary); little or no material may be wasted, resulting in a low cost and low weight air cooler 26. In addition, this conservative approach may reduce the manufacturing processes and time required to produce the disclosed heat exchanger.

It will be apparent to those skilled in the art that various modifications and variations can be made to the disclosed exhaust control system. Other embodiments will be apparent to those skilled in the art from consideration of the specification and practice of the disclosed exhaust control system. For example, although air cooler 26 is depicted and described as an air-to-air or air-to-liquid heat exchanger, it is contemplated that fluid passageways 100 having the variable anti-corrosive characteristics may be equally applicable to a liquid-to-liquid type of heat exchanger. It is intended that the specification and examples be considered as exemplary only, with a true scope being indicated by the following claims and their equivalents.

What is claimed is:

1. A heat exchanger, comprising:

an inlet;

an outlet; and at least one passageway fluidly connecting the inlet and the outlet, the at least one passageway having a corrosive resistive feature that varies along a length of the at least one passageway, and the corrosive resistive feature including a wall thickness of the at least one passageway, wherein the wall thickness of the at least one passageway increases in a stepwise manner at a predetermined position between the inlet and the outlet.

2. The heat exchanger of claim 1, wherein the wall thickness at an end of the at least one passageway near the outlet is greater than the wall thickness of an end at the at least one passageway near the inlet.

3. The heat exchanger of claim 2, wherein the wall thickness of the at least one passageway gradually increases along at least a portion of the length of the at least one passageway.

4. The heat exchanger of claim 1, wherein the wall thickness of the at least one passageway is greater near the outlet than near the inlet.

5. The heat exchanger of claim 4, wherein the wall thickness of the at least one passageway increases gradually along at least a portion of the passageway from the inlet to the outlet.

6. The heat exchanger of claim 1, wherein the feature further includes a coating on a wall of the at least one passageway.

7. The heat exchanger of claim 6, wherein the coating is only on a wall portion of the at least one passageway near to the outlet.

8. The heat exchanger of claim 6, wherein the coating on a wall portion of the at least one passageway near the outlet is thicker than the coating on a wall portion of the at least one passageway near the inlet.

9. A heat exchanger, comprising:

an inlet;

an outlet; and at least one passageway fluidly connecting the inlet and the outlet, the at least one passageway having a corrosive resistive feature that varies along a length of the at least one passageway, the corrosive resistive feature including a wall material of the at least one passageway, wherein the wall portion of the at least one passageway near the inlet is a first material and the wall portion of the at least one passageway near the outlet is a second material.

10. The heat exchanger of claim 9, wherein the first material is aluminum.

11. The heat exchanger of claim 10, wherein the second material is stainless steel.

12. An air handling system for an engine, comprising:

a supply of air;

a supply of recirculated exhaust gas;

a compressor in communication with the supply of air and the supply of recirculated exhaust gas, the compressor being configured to compress a mixture of air and recirculated exhaust gas;

an inlet manifold in fluid communication with the engine; and a heat exchanger configured to cool the compressed air and recirculated exhaust gas mixture and to direct the cooled mixture to the inlet manifold, the heat exchanger including:

an inlet in communication with the supply of air and the supply of recirculated exhaust gas;

an outlet in communication with the inlet manifold; and at least one passageway fluidly connecting the inlet and the outlet, the at least one passageway having a corrosive resistive feature that varies along a length of the at least one passageway, the corrosive resistive feature including a coating on a wall of the at least one passageway, wherein the coating on a wall portion of the at least one passageway near the outlet is thicker than the coating on a wall portion of the at least one passageway near the inlet.

13. The air handling system of claim 12, wherein the coating is only on a wall portion of the at least one passageway near the outlet.

14. The air handling system of claim 12, wherein the feature further includes a wall material of the at least one passageway.

15. The air handling system of claim 14, wherein the wall portion of the at least one passageway near the inlet is aluminum, and the wall portion of the at least one passageway near the outlet is stainless steel.

16. The air handling system of claim 12, wherein the feature further includes a wall thickness of the at least one passageway.

17. The air handling system of claim 16, wherein the wall thickness at an end of the at least one passageway near the outlet is greater than the wall thickness of an end at the at least one passageway near the inlet.

18. The air handling system of claim 17, wherein the wall thickness of the at least one passageway gradually increases along the length of the at least one passageway.

19. The air handling system of claim 17, wherein the wall thickness of the at least one passageway increases in a stepwise manner at a predetermined position along the length of the at least one passageway.

* * * * *

UNITED STATES PATENT AND TRADEMARK OFFICE

CERTIFICATE OF CORRECTION

PATENT NO. : 7,357,126 B2
APPLICATION NO. : 11/311303
DATED : April 15, 2008
INVENTOR(S) : Durand et al.

It is certified that error appears in the above-identified patent and that said Letters Patent is hereby corrected as shown below:

On the Title Page,
Please correct the Inventor as follows:
Title page, item (75), in Column 1, Line 2, delete "Kulkami" and insert -- Kulkarni --.

Please correct the Attorney, Agent, or Firm as follows:
Title page, item (74), in Column 2, Line 2, delete "Dunne" and insert -- Dunner --.

Please correct the Specification as follows:
Column 6, line 10–11, after "necessary)" delete ";" and insert -- , --.

Signed and Sealed this

Fourth Day of November, 2008

JON W. DUDAS
*Director of the United States Patent and Trademark Office*